US006701924B1

(12) United States Patent
Land, Jr. et al.

(10) Patent No.: US 6,701,924 B1
(45) Date of Patent: Mar. 9, 2004

(54) NASAL FILTER

(76) Inventors: Richard D. Land, Jr., 1323 S. St Cloud Ave., Valrico, FL (US) 33594; Dawn Land, 1323 S. St Cloud Ave., Valrico, FL (US) 33594

( * ) Notice: Subject to any disclaimer, the term of this patent is extended or adjusted under 35 U.S.C. 154(b) by 0 days.

(21) Appl. No.: 10/266,199

(22) Filed: Oct. 7, 2002

(51) Int. Cl.[7] ..... A61G 10/00

(52) U.S. Cl. ..... 128/206.11; 128/204.12; 128/204.11; 128/203.22; 128/207.18; 128/204.13; 128/203.12; 128/201.18

(58) Field of Search ..... 128/206.11, 204.12, 128/204.11, 203.22, 207.18, 204.13, 203.12, 201.18

(56) References Cited

U.S. PATENT DOCUMENTS 810,617 A * 1/1906 Carence ..... 128/206.11
3,463,149 A * 8/1969 Albu ..... 128/204.12
4,220,150 A * 9/1980 King ..... 128/206.11
4,221,217 A * 9/1980 Amezcua ..... 128/206.11
4,369,783 A * 1/1983 Hiller et al. ..... 604/11
5,787,884 A * 8/1998 Tovey ..... 128/206.11
5,854,269 A * 12/1998 Haslwanter et al. ..... 514/385
6,015,425 A * 1/2000 Altadonna, Jr. ..... 606/204.45

* cited by examiner

*Primary Examiner*—Henry Bennett
*Assistant Examiner*—Mark Rademacher

(57) ABSTRACT

The nasal filter is a breathing aid that would filter pollutants and contaminants from the air, thus improving the quality of the air inhaled by individuals who suffer respiratory ailments and allergies to air borne pollutants. Designed to fit just inside the nostrils, the nasal filter would consist of a spring clip having flanged two-pronged ends with an oval shaped filtering member on each end. The filtering elements would be made of a medium grade cotton rolled into an appropriate configuration to fit the nostril, and could possibly be impregnated with oxymetazoline to aid in the treatment of nasal congestion. The flanged ends would secure the device in place during exhalation, and could also be useful in replacing the disposable filtering elements. The spring clip could be offered in clear or flesh-toned plastic and could also be offered in a variety of sizes to fit different user's noses.

5 Claims, 2 Drawing Sheets

NASAL FILTER

BACKGROUND OF THE INVENTION

1. Field of the Invention

The present invention relates to a nasal appliance for use in connection with filtering pollutants from the air. The nasal filter has particular utility in connection with improving the quality of the air inhaled by individuals who suffer respiratory ailments and allergies to air borne pollutants.

2. Description of the Prior Art

Many individuals are susceptible to allergies or respiratory ailments due to airborne pollution, microorganisms, pathogens, or other particles entrained in the ambient air. Allergy sufferers are exposed to various pollens during certain periods of the year, which can cause severe allergic reactions within the body of the exposed person. Moreover, persons working in various medical professions, mining, construction, lawn services, or other occupations are continuously exposed to particulate material entrained in the ambient atmosphere which is inhaled into the respiratory system during breathing. A variety of masks exist which can be worn for filtering impure air, most fit over the mouth and are held in place by a string, an elastic cord, or straps which fit around the back of the head or ears. Many of these masks are uncomfortable due to improper fit and a buildup of heat in the area of the mask due to trapped exhalation from the user. Improper fit can also lead to unfiltered air entering the respiratory system. Finally, the mask interferes with the wearer's ability to talk, eat, and perform other functions.

A nasal filter overcomes these deficiencies, allowing the user to breathe filtered air through the nostrils while the user's mouth is free for talking, eating, and other purposes. Nasal filters come in a variety of shapes and sizes and typically have two filter elements, one of which fits in each nasal passage, connected by a clip for positioning and removing the filter elements. However these filter elements can be uncomfortable when placed in the nostrils, due to improper fit. Additionally, the clip can fail to hold the filter elements properly in the nasal passages as well as being highly visible to other people. Therefore, a nasal filter which could be comfortably and securely worn without being highly visible would be beneficial to the user.

The use of nasal filters is known in the prior art. For example, U.S. Pat. No. 4,220,150 to John R. King discloses a nasal dust filter that contains two disposable umbrella-shaped filter elements joined by a clip which applies pressure on the septum walls to maintain its positioning. However, the King '150 patent would not form a good seal against the septum walls if the septum is not rounded, allowing unfiltered air to pass into the respiratory system. Additionally, the clip is made of hard plastic, which would be uncomfortable to wear for any length of time, and is not flanged on the ends so that it does not provide a brace against which the fingers can be placed when replacing the filter elements.

U.S. Pat. No. 5,485,836 to Robert A. Lincoln discloses a nasal air filter that includes a filter element and an adhesive strip which includes two substantially triangular portions designed to adhere to the sides of the nose and hold the filter in place. The adhesive strip is such that it securely holds the filter over the nostrils when the adhesive strip is properly placed on the sides of the nose. However, the Lincoln '836 patent would not provide a sufficient seal at the base of the nose, especially since the device could become lose when sweat or natural oil from the skin comes in contact with the adhesive strip. Furthermore, the adhesive strip of the Lincoln '836 device could irritate the skin to which it was attached, especially if the device needed to be worn for a substantial amount of time. Finally, the Lincoln '836 device is highly visible to other people and could cause embarrassment to the user.

Similarly, U.S. Pat. No. 2,264,153 to Leonard Rowe discloses a nasal appliance that consists of two cage-like thimble filters for insertion in the nostrils which are joined together by a rigid U-shaped yoke which straddles the septum of the nose and holds the thimbles in place. After the filters are inserted into the nostrils, the yoke is crimped together to ensure a proper fit. However, the Rowe '153 patent does not provide a proper fit for the nose because of the rigid yoke, and could possibly be uncomfortable to wear. In addition, customizing the Rowe '153 to provide a secure fit would require extra tools such as a crimping device. Finally, the complicated design of the Rowe '153 device would make replacing the filters difficult and could cause higher manufacturing costs.

U.S. Pat. No. 4,327,719 to Irene J. Childers discloses a nose filter that includes two cylindrical filter plug members joined by a semi-rigid yoke. However, the Childers '719 patent provides for a cylindrical filter plug member, which would not necessarily fit all nostril shapes. Moreover, since the filter plug members of the Childers '719 patent do not fully extend into the nostril, they are not only highly visible, but they could also easily fall out during sneezing or exhalation. Lastly, the yoke of the Childers '719 device is not adjustable, making the possibility of achieving a secure fit less likely, and the filters are not easily replaced on the plug members.

Likewise, U.S. Pat. No. 4,221,217 to Saul O. Amezcua discloses a nasal device that contains two frusto-conical filter elements joined by a flat U-shaped yoke. However. it is unlikely that the filter elements of the Amezcua '217 patent could be fully inserted into the nostril, making it highly visible to other people and leading to possible slippage of the device. Additionally, the flat bottom of the U-shaped yoke in the Amezcua '217 patent would require the yoke to be placed directly against the base of the nose for a secure fit, causing irritation to a user who wore the device for any length of time.

Lastly, U.S. Pat. No. Des. 251,017 to Saul O. Amezcua discloses the ornamental design for a nasal device that contains two frusto-conical filter elements joined on the internal edges by a U shaped yoke. However, the filters of the Amezcua '017 patent would be difficult to change due to the shape of the filter elements. Furthermore, the rigid U-shaped yoke is not adjustable and might not provide a secure fit for various shapes and sizes of nasal passages.

While the above-described devices fulfill their respective, particular objectives and requirements, the aforementioned patents do not describe a nasal filter that allows a secure comfortable fit while maintaining low external visibility and ease of filter replacement. Each of the aforementioned patents is deficient in providing a secure fit for the nasal filter. The King '150 and Childers '719 patents provide rounded filter plug members, which would not form a good seal against the septum walls if the septum is not rounded, allowing unfiltered air to pass into the respiratory system. Moreover, the yoke of the Childers '719 device is not adjustable, making the possibility of achieving a secure fit even less likely. The Lincoln '836 patent would not provide a sufficient seal at the base of the nose, especially since the device could become lose when sweat or natural oil from the skin comes in contact with the adhesive strip. The Rowe '153 and Amezcua '017 patents do not provide a proper fit for the nose because of the rigid yoke, and would be uncomfortable to wear for any extended length of time. Both the Childers '719 and Amezcua '217 patents provide for filter elements which do not fully extend into the nostril, leading to possible slippage during sneezing and exhalation, as well as making both devices highly visible. The Lincoln '836 device is also highly visible to other people and could cause embarrassment to the wearer. The King '150 and the Amezcua '217 devices would be uncomfortable to wear due to the rigid yokes placed against the base of the nose. Additionally, the adhesive strip of the Lincoln '836 device could irritate the skin to which it was attached, especially if the device needed to be worn for a substantial amount of time. Finally, the King '150, Rowe '153, Childers '719, and Amezcua '017 patents all provide for devices which could make the replacement of the filter elements difficult.

Therefore, a need exists for a new and improved nasal filter that can be used for improving the quality of inhaled air while providing a comfortable, secure, low visibility fit and easy to replace filters. In this regard, the present invention substantially fulfills this need. In this respect, the nasal filter according to the present invention substantially departs from the conventional concepts and designs of the prior art, and in doing so provides an apparatus primarily developed for the purpose of improving the quality of the air inhaled by individuals who suffer respiratory ailments and allergies to air borne pollutants.

SUMMARY OF THE INVENTION

In view of the foregoing disadvantages inherent in the known types of nasal filters now present in the prior art, the present invention provides an improved nasal filter, and overcomes the above-mentioned disadvantages and drawbacks of the prior art. As such, the general purpose of the present invention, which will be described subsequently in greater detail, is to provide a new and improved nasal filter which has all the advantages of the prior art mentioned heretofore and many novel features that result in a nasal filter which is not anticipated, rendered obvious, suggested, or even implied by the prior art, either alone or in any combination thereof.

To attain this, the present invention essentially comprises a nasal filter which includes a U-shaped spring clip element for positioning filtering means within the nasal passages of a user, such that the filter means are formed of unique cotton ball elements having the ability to pass air therethrough, and such that the cotton ball means are removably coupled to the U-shaped spring element via unique clipping elements designed to engage the base of the cotton ball element without undue manipulation thereof.

There has thus been outlined, rather broadly, the more important features of the invention in order that the detailed description thereof that follows may be better understood and in order that the present contribution to the art may be better appreciated.

The invention may also include an addition of oxymetazoline to the filter members for aid in decongesting the user and neutralizing airborne bacteria. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved nasal filter that has all of the advantages of the prior art nasal filters and none of the disadvantages.

It is another object of the present invention to provide a new and improved nasal filter that may be easily and efficiently manufactured and marketed.

An even further object of the present invention is to provide a new and improved nasal filter that has a low cost of manufacture with regard to both materials and labor, and which accordingly is then susceptible of low prices of sale to the consuming public, thereby making such a nasal filter economically available to the buying public.

Still another object of the present invention is to provide a new nasal filter that provides in the apparatuses and methods of the prior art some of the advantages thereof, while simultaneously overcoming some of the disadvantages normally associated therewith.

Even still another object of the present invention is to provide a nasal filter for providing an improved quality of inhaled air. This allows individuals who suffer respiratory ailments and allergies to air borne pollutants to reduce the introduction of these elements into their respiratory systems.

Yet another object of the present invention is to provide a nasal filter which affords a low amount of visibility to other people. This allows the wearer to enjoy the benefits of inhaling less contaminated air without suffering embarrassment.

Still yet another object of the present invention is to provide a nasal filter which is comfortable to wear and is not easily dislodged during exhalation. This provides the wearer with a sense of security and comfort when wearing the nasal filter, especially over extended periods of time.

Even yet another object of the present invention is to provide a nasal filter in which the filtering elements or the entire device is disposable. This allows the user to dispose of the entire device if recontamination is likely to occur and to replace used filter elements under other circumstances.

Lastly, it is an object of the present invention to provide a new and improved nasal filter which is treated with oxymetazoline. This allows further treatment of nasal congestion targeted at the exact area of the body where the symptoms are most prevalent.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
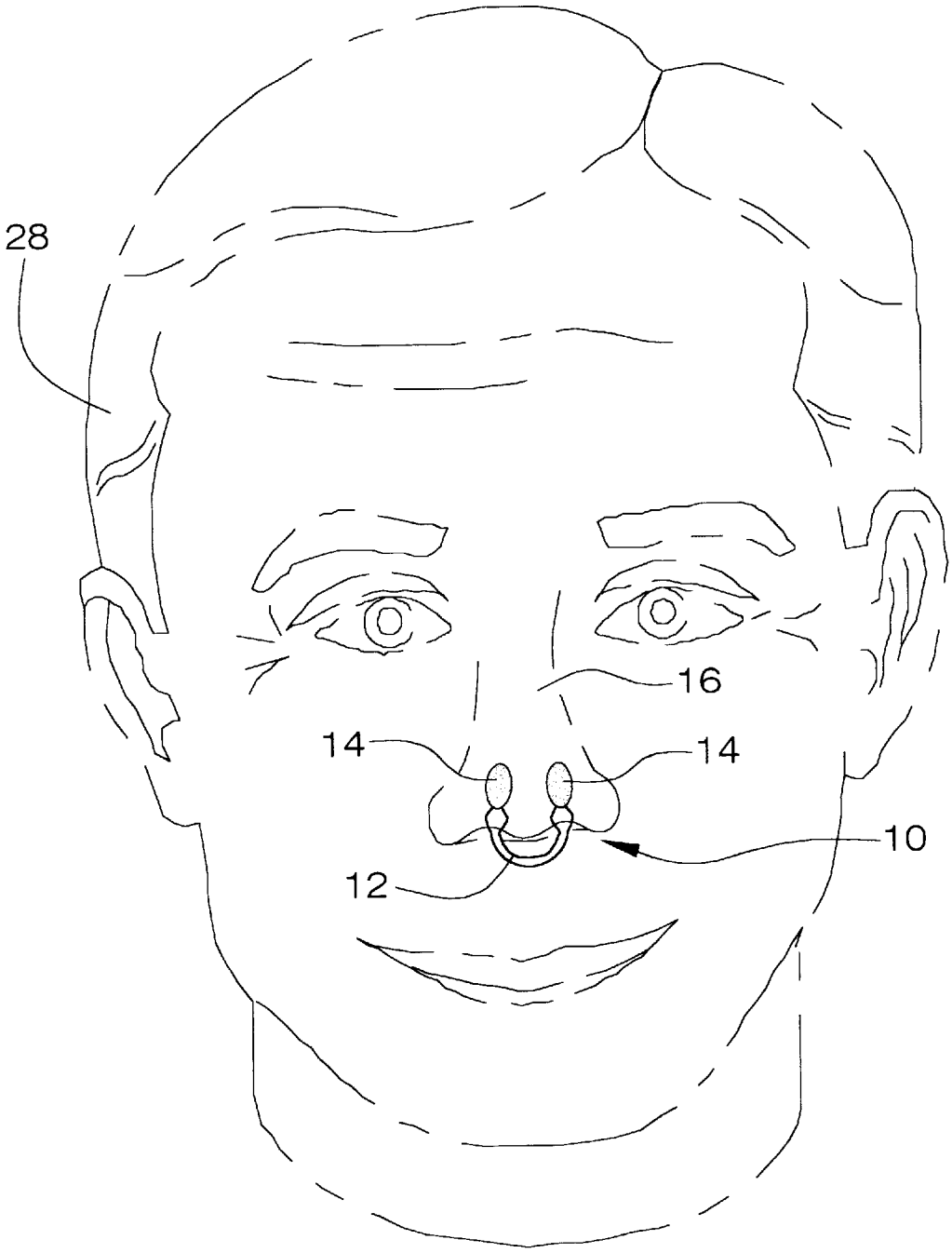
FIG. 1 is a front view of the preferred embodiment of the nasal filter as employed by the user and constructed in accordance with the principles of the present invention.
Figure 2:
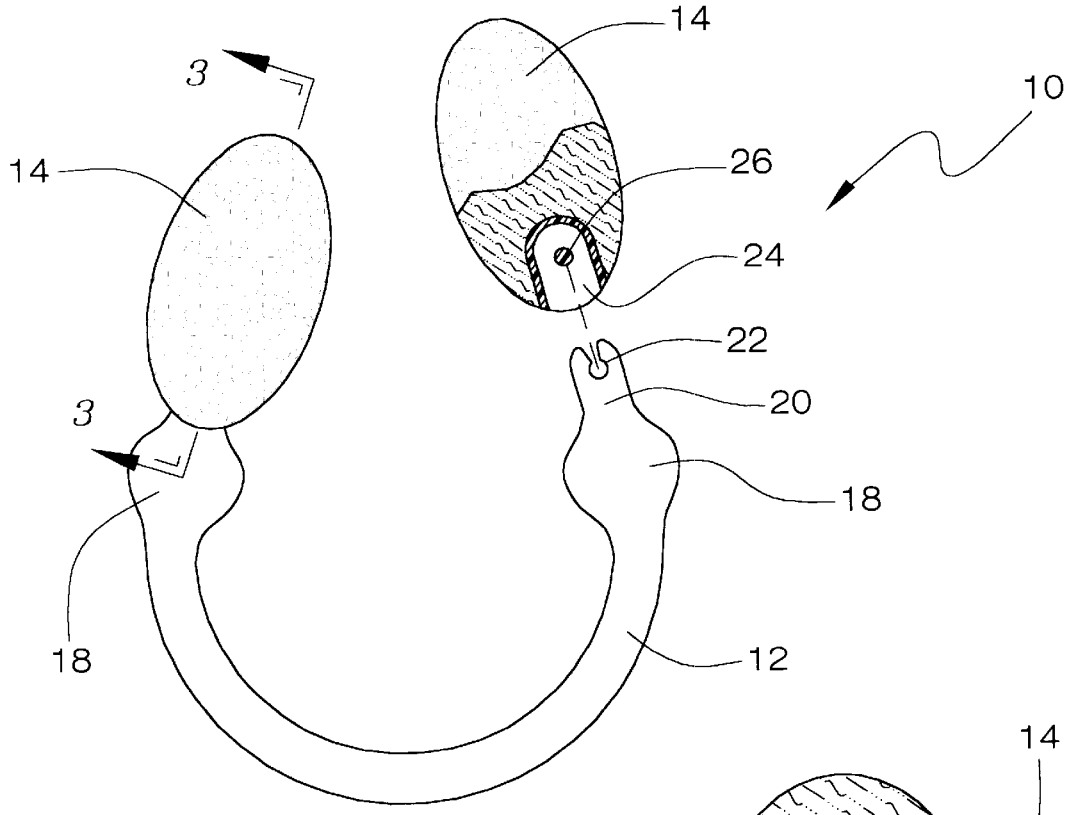
FIG. 2 is a front view of the nasal filter of the present invention.
Figure 3:
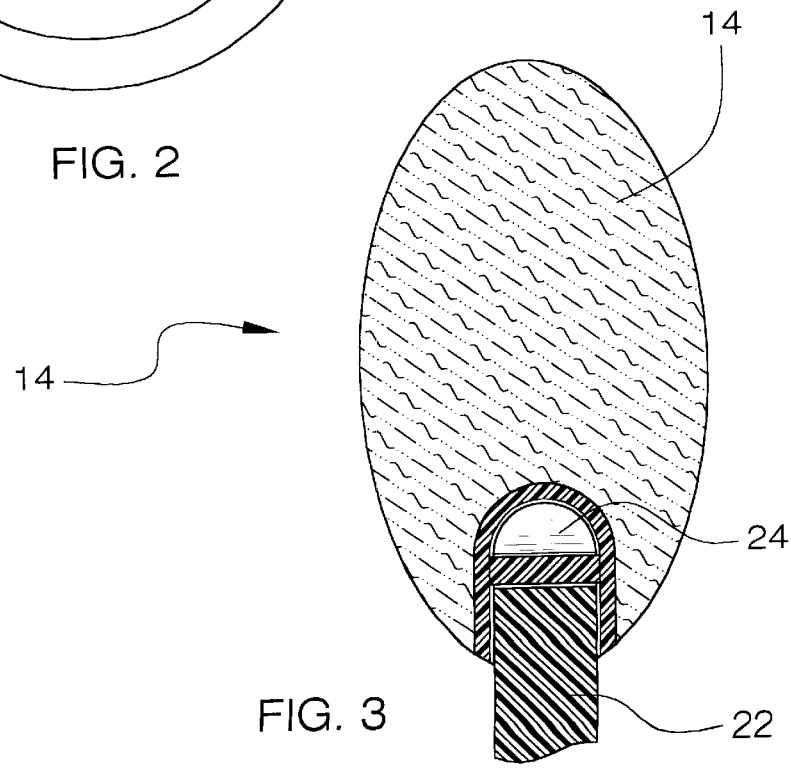
FIG. 3 is a side sectional view of the filter member of the nasal filter of the present invention.

Referring now to the drawings, and particularly to FIGS. 1–3, a preferred embodiment of the nasal filter of the present invention is shown and generally designated by the reference numeral 10.

In FIG. 1, a new and improved nasal filter 10 of the present invention for improving the quality of inhaled air while providing a comfortable, secure, low visibility fit and easy to replace filters is illustrated and will be described. More particularly, the nasal filter 10 has a U-shaped clear plastic nose clip 12 with an oval filter member 14 mounted on each end. Each filter member 14 would be placed inside one of the nostrils of the nose 16 of the wearer 28. The nose clip 12 would extend slightly below the base of the nose 16. The nose clip 12 would also ensure that the device is prevented from being completely inserted inside the nose 16 and could be used as an aid in removing the nose filter 10 form the nose 16 after use. In addition to clear plastic, the nose clip 12 could be offered in various skin tone colors to minimize the visibility of the device.

FIG. 2 shows a front detail view of the nasal filter 10 of the present invention. The nose clip 12 has a broad U-shape with a flange 18 and a two-pronged filter clip 20 on each end. The prongs 22 of the filter clip 20 are placed around the base 24 of the filter member 14 for a secure mounting and easy replacement. The base 24 of the filter member 14 has an aperture 26 into which the prongs 22 of the filter clip 20 fit to secure the mounting. The flanges 18 on each end of the nose clip 12 secure the device during exhalation and afford additional aid in replacing the filter member 14. The wearer simply places his fingers on one side of the flange 18 when pulling the used filter member 14 from the filter clip 20 and when placing a new filter member 14 on the filter clip 20. The oval shaped filter member 14 would consist of medium grade cotton which has been rolled or formed into the oval configuration and fits around the base 24. The filter members 14 could also be impregnated with oxymetazoline in the cotton material. This agent could be beneficial in the treatment of nasal congestion.

FIG. 3 shows a side sectional view of the filter member 14 of the nasal filter 10. The oval shaped filter member 14 has a rigid base 24 into which the filter clip 20 is inserted. One prong 22 of the filter clip 20 fits on each side of the base 24 to effect a secure mounting.

In use, it can now be understood that the user would quickly and easily apply the nasal filter by placing the filter members just inside the nostrils and adhering it to the center of the nose using the nostril clip. When properly positioned, the nasal filter would provide protection for the wearer's respiratory system from potentially harmful debris and pollutants in the air. Because of the unit's filtering capabilities, poor air would be filtered as it entered the wearer's nostrils. Thus, the individual would be able to breathe clean air, which could improve his overall health.

The nasal filter of the present invention could be worn in public with little attention drawn to the individual. Its small size and blended color would make it less noticeable while providing valuable benefits. The lightweight and compact design would make it comfortable to wear. The filter would be employed once and then could be easily removed and properly discarded when no longer needed. The wearer would simply grasp the nose clip and remove the nasal filter from his nostrils. The filter members could then be easily replaced for future use, or the entire device could be discarded. The disposability of the product would eliminate the spread of germs and bacteria and avoid recontamination that can occur with the use of nasal spray bottles.

Unlike congestion medicines, the nasal filter would provide fast-acting, continual relief right to the source of discomfort, eliminating the standard side effects of such medications which include drowsiness, irritability, excitability, and irritation.

The nasal filter would also provide continual relief at night, allowing the wearer to enjoy a restful night's sleep. Nasal discharge would be absorbed by the cotton inserts, eliminating the constant nose blowing throughout the night that is associated with colds and allergies. The filter members could also be treated with oxymetazoline, which could be beneficial in the treatment of nasal congestion.

Finally, the nasal filter of the present invention might also be used in industrial applications such as mining and construction where individuals are endangered by breathing work related pollutants in the air. Individuals could also protect against inhaling such bacteria as anthrax into their respiratory system by using the nasal filter.

While a preferred embodiment of the nasal filter has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, rubber, or a variety of wood may be used for the nose clip described. Furthermore, a wide variety of medicinal applications may be used instead of the oxymetazoline described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A nasal filter comprising:

a U-shaped spring clip having a first leg with a flanged first end and a multi-pronged connector extending from the center of said flanged end and a second end, a curved middle portion extending from said second end of said first leg, and a second leg with a flanged first end and a multi-pronged connector extending from the center of said flanged end and a second end extending from said curved middle portion;

a first filter member having a thin, rigid base member formed with a transverse aperture and surrounded by a filtering unit and removably connected at said base member to said multi-pronged connector of said first leg of said spring clip; and a second filter member having a thin, rigid base member formed with a transverse aperture and surrounded by a filtering unit and removably connected at said base member to said multi-pronged connector of said second leg of said spring clip.

2. The nasal filter of claim 1 wherein said connector of said first leg of said spring clip extends from and is formed as a single unit with said first leg of said spring clip and is formed with a first prong and a second prong parallel to and spaced sufficiently close to said first prong wherein said first and said second prongs can slide along said base member of said first filter member until said prongs reside in said transverse aperture of said first filter member.

3. The nasal filter of claim 2 wherein said connector of said second leg of said spring clip extends from and is formed as a single unit with said second leg of said spring clip and is formed with a first prong and a second prong parallel to and spaced sufficiently close to said first prong wherein said first and said second prongs can slide along said base member of said second filter member until said prongs reside in said transverse aperture of said second filter member.

4. The nasal filter of claim 3 wherein said filtering unit of said first filter member and said filtering unit of said second filter member are made of an absorptive material formed in an oval shape and formed to fit snugly inside a nostril.

5. A nasal filter comprising:

a U-shaped spring clip having a curved middle portion, a first leg extending from said middle portion and formed with a flange and a two-pronged end extending from the center of said flange, and a second leg extending from said middle portion and formed with a flange and a two-pronged end extending from the center of said flange;

a first absorptive filter member having a thin, rigid base member formed with a transverse aperture and surrounded by a filtering unit and slideably and removably connected to said two-pronged end of said first leg of said spring clip;

a second absorptive filter member having a thin, rigid base member formed with a transverse aperture and surrounded by a filtering unit and slideably and removably connected to said two-pronged end of said second leg of said spring clip; and a medicinal application infused into said first absorptive filter member and said second absorptive filter member.

* * * * *